United States Patent [19]

Joshi et al.

[11] Patent Number: 5,067,561

[45] Date of Patent: Nov. 26, 1991

[54] RADIATOR TANK OIL COOLER

[75] Inventors: Shrikant M. Joshi, Getzville; Frederick V. Oddi, Orchard Park, both of N.Y.

[73] Assignee: General Motors Corporation, Detroit, Mich.

[21] Appl. No.: 620,169

[22] Filed: Nov. 30, 1990

[51] Int. Cl.[5] ..... F01P 11/08; F28F 9/22; F28F 9/26

[52] U.S. Cl. ..... 165/140; 165/174; 165/916; 123/41.33; 184/104.1; 184/104.3

[58] Field of Search ..... 165/41, 51, 140, 916, 165/174; 123/41.33, 196 AB; 184/104.1, 104.2, 104.3, 6.22

[56] References Cited

U.S. PATENT DOCUMENTS

| | | | |
|---|---|---|---|
| 2,014,028 | 9/1935 | Palmer | 165/51 |
| 2,054,403 | 9/1936 | Yeager | 184/104.3 |
| 4,227,570 | 10/1980 | Crews | 165/140 |
| 4,373,578 | 2/1983 | Saperstein et al. . | |
| 4,700,774 | 10/1987 | Schwarz | 165/140 |
| 4,903,760 | 2/1990 | Joshi et al. . | |

FOREIGN PATENT DOCUMENTS

| | | | |
|---|---|---|---|
| 557762 | 8/1932 | Fed. Rep. of Germany | 165/140 |
| 3303500 | 8/1983 | Fed. Rep. of Germany | 165/916 |

*Primary Examiner*—John Ford
*Attorney, Agent, or Firm*—Ronald L. Phillips

[57] ABSTRACT

Baffles are arranged relative to an oil cooler mounted in one of the tanks of a motor vehicle radiator so as to force coolant through the oil cooler rather than allow coolant to bypass same for enhanced heat transfer.

6 Claims, 1 Drawing Sheet

RADIATOR TANK OIL COOLER

TECHNICAL FIELD

This invention relates to radiator tank oil coolers and more particularly to the coolant circulation relative to such coolers.

BACKGROUND OF THE INVENTION

In motor vehicles where there is a need to cool the engine or automatic transmission oil, it is common practice to add an oil cooler that is mounted in either the inlet or outlet tank of the engine radiator. There heat from the oil is transferred to the coolant for rejection in the radiator core to ambient air. Such coolers are typically constructed of tubes formed from flat plates with tubulators or extended surface provided therein. The coolant either leaves the radiator core (tubes) and flows past the oil cooler tubes in the outlet tank or flows first past the oil cooler in the inlet tank and then through the radiator core. And when more oil cooling capacity is needed, the number of oil cooler tubes (pairs of tube plates) is increased. It would, therefore, be advantageous if the capacity could be increased without having to add such parts.

SUMMARY OF THE INVENTION

In arriving at the present invention, it was discovered that because the coolant passing through the radiator tank having the oil cooler will travel the path of least resistance, the coolant has a natural tendency to flow around or bypass the oil cooler rather than flow between the oil cooler plates, thereby reducing the heat transfer (rejection) available. And the less the number of oil cooler tubes, the larger the undesirable bypass flow around the oil cooler in a given radiator tank.

The present invention provides a very simple cost efficient solution to these problems with the provision of baffles located either side of the oil cooler. The baffles extend between the outermost tubes of the oil cooler and the interior of the radiator tank in which the oil cooler is mounted (either the inlet or outlet tank). The baffles are made imperforate to prevent any bypass around the outermost oil cooler tubes and instead force the coolant flow between the oil cooler tubes. Or the baffles may be perforated to a certain degree to provide a controlled amount of coolant across the outer surfaces of the oil cooler. In either case, the baffles effect increased coolant velocity between the inner oil tubes that significantly increases the heat transfer coefficient at the latter's surfaces resulting in a correspondingly higher heat transfer rate without the addition of more costly oil cooler tubes.

It is therefore an object of the present invention to provide in an engine coolant radiator tank an oil cooler having increased cooling capacity provided by baffling external of the oil cooler tubes rather than by the addition of oil cooler tubes.

Another object is to provide in an engine coolant radiator tank an oil cooler having baffling arranged relative thereto that forces coolant flow between the oil cooler tubes.

Another object is to provide in an engine coolant radiator tank an oil cooler having baffling arranged relative thereto that prevents bypass coolant flow around the oil cooler and forces coolant flow between the oil cooler tubes.

Another object is to provide in an engine coolant radiator tank an oil cooler having a baffle arrangement that provides controlled coolant flow around the outermost oil cooler tubes while forcing a majority of the incoming coolant flow between the inner oil cooler tubes.

These and other objects, advantages and features of the present invention will become more apparent from the following description and drawing in which:

DESCRIPTION OF THE PREFERRED EMBODIMENT

Figure 1:
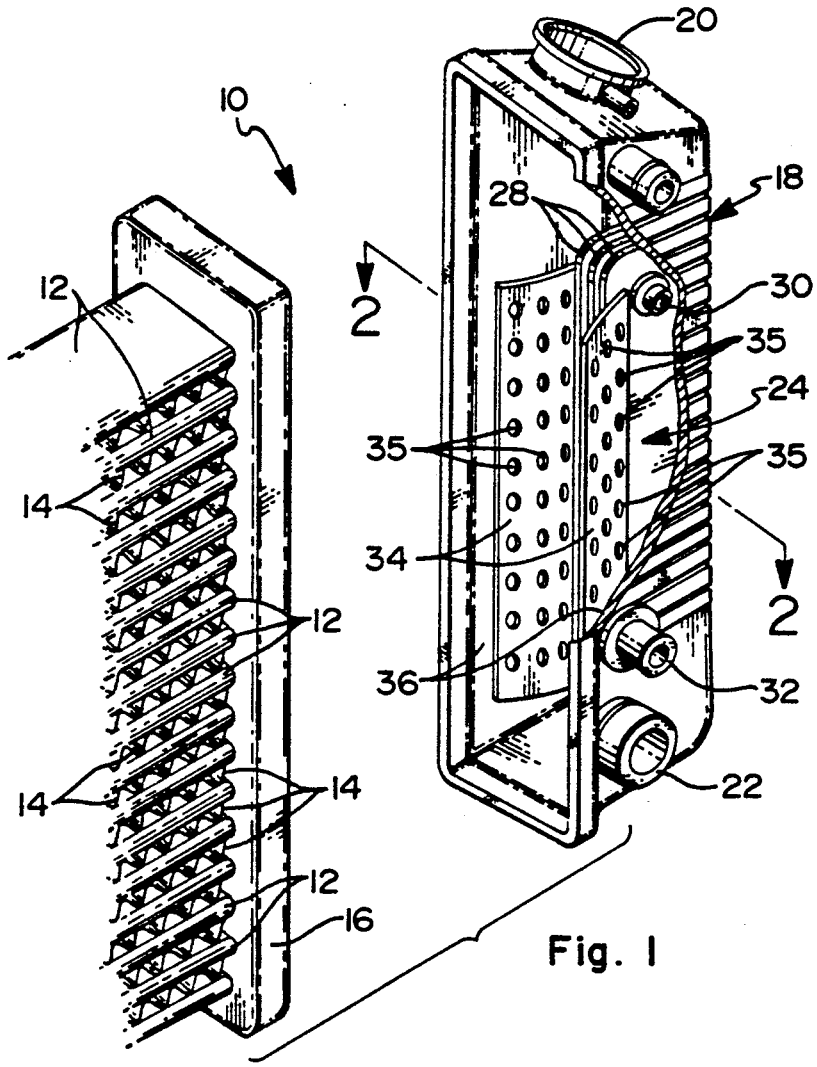
FIG. 1 is a three dimensional exploded view of one end of an engine radiator having an inlet tank, oil cooler and baffle assembly constructed according to the present invention shown removed from this end of the radiator core.

Referring to FIG. 1, there is shown a cross-flow radiator 10 for cooling the coolant circulated through a motor vehicle's engine (not shown). The radiator comprises a core having tubes 12 with air centers 14 therebetween. The tubes are joined at their opposite ends to a header plate 16 (only one shown) to complete the core. A tank 18 is sealingly joined to each header about the periphery thereof with one tank serving as the inlet tank and the other as the outlet tank (only the outlet tank being shown). The outlet tank has a filler neck 20 at its upper end, an outlet fitting 22 at its lower end, and an oil cooler 24 mounted in the outlet tank between the filler neck and the outlet fitting.

The oil cooler is of the plate type and comprises a plurality of pairs of tube plates 26 (three pair shown) wherein each pair defines a tube 28. The tubes 28 are arranged side by side in a row and extend across the ends of the radiator tubes at this end of the core. The cooler tubes 28 are joined at their opposite ends to an inlet fitting 30 and outlet fitting 32 which sealingly extend through one side of the outlet tank and communicate the cooler with the oil in either an engine or automatic transmission (neither of which is shown) of a motor vehicle. Moreover, the fittings 30 and 32 support the oil cooler in the tank. The componentry thus far described is conventional and operates in the normal manner except for the heat transfer enhancement of the oil cooler now to be described. And except for such enhancement, the coolant leaving the ends of the radiator tubes and flowing toward the tank outlet fitting 22 has a tendency to follow the path of least resistance and thus flow around the oil cooler rather than through the cooler between its tubes 28.

Figure 3:
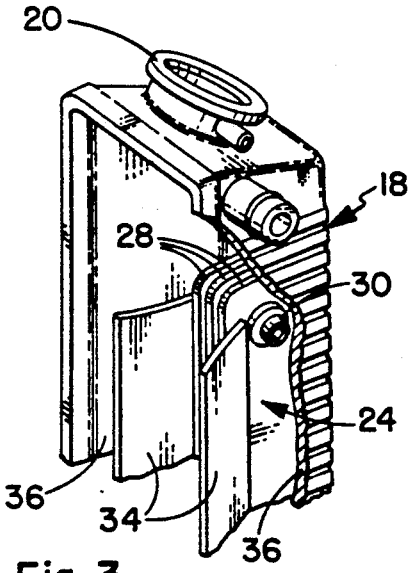
FIG. 3 is a fragmentary view which corresponds to FIG. 1 but shows a baffle assembly which is imperforate.
Figure 2:
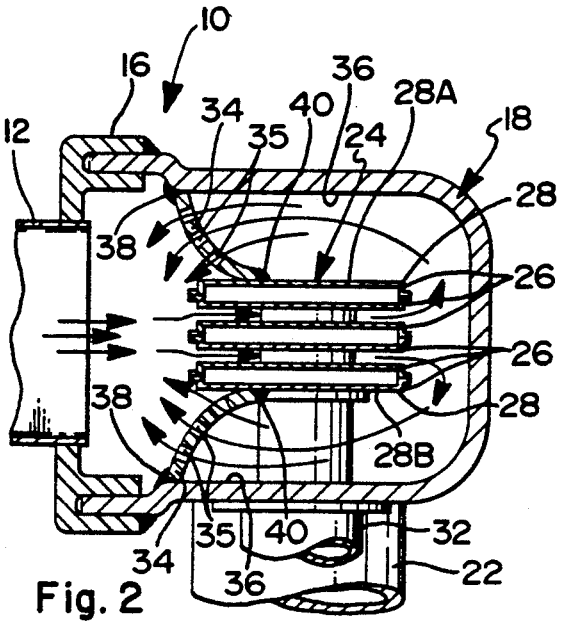
FIG. 2 is an enlarged sectional view taken along the line 2—2 in FIG. 1.

According to the present invention, a pair of baffles 34 are mounted on opposite sides of the oil cooler between the two outermost tubes 28A and 28B of the cooler tube row and the interior side 36 of the radiator outlet tank. The baffles 34 are formed from sheet stock and extend the length of the oil cooler and are bonded along their longitudinal edges by bonds 38 and 40 to the radiator tank interior 36 and the outer sides of the oil cooler. The baffles, 34 are either perforated with holes 35 as shown in FIG. 1 or are imperforate as shown in FIG. 3. In either case, they are formed with a convex side to the flow from the radiator tubes so as to funnel or force this flow to pass between the oil cooler tubes rather than be allowed to bypass same. This results in significantly increased coolant velocity across the surface of the oil cooler tubes and a corresponding increase in their coefficient of heat transfer and thus a higher heat transfer rate. The perforations 35 in the baffles are employed where there is some significant advantage from a heat transfer or pressure drop standpoint to having some controlled flow across the outer sides of the oil cooler as opposed to allowing no bypass with imperforate baffles. The flow pattern that results with the perforations is shown by the arrows in FIG. 2. Without such perforations there would, of course, be no such limited flow (bypass flow) through the baffles. Moreover, the design of the baffles allows them to be bent in place after the oil cooler is mounted so that they do not interfere with the cooler to radiator tank assembly.

The foregoing description of the preferred embodiment of the invention has been presented for purposes of illustration and description. It is not intended to be exhaustive or to limit the invention to the precise form disclosed. Obvious modifications or variations are possible on light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally and equitably entitled.

We claim:

1. In combination, a motor vehicle radiator having a tank, a plurality of radiator tubes connected at one end thereof to said tank, a fitting on said tank for directing liquid into or out of said tank to or from respectively the one end of said radiator tubes, an oil cooler mounted in said tank between the one end of said radiator tubes and said fitting, said oil cooler having a row of tubes extending past and open to the one end of said radiator tubes, said tank having an interior side facing said oil cooler, and baffle means on opposite sides of the one end of said radiator tubes extending between said interior side of said tank and the oil cooler tubes so as to force liquid flowing between said fitting and the one end of said radiator tubes to pass transversely between said oil cooler tubes.

2. In combination, a motor vehicle radiator having a tank, a plurality of radiator tubes connected at one end thereof to said tank, a fitting on said tank for directing liquid into or out of said tank to or from respectively the one end of said radiator tubes, an oil cooler mounted in said tank between the one end of said radiator tubes and said fitting, said oil cooler having a row of tubes extending past and open to the one end of said radiator tubes, said tank having an interior side facing said oil cooler, and baffle means on opposite sides of the one end of said radiator tubes extending between said interior side of said tank and the oil cooler tubes at each end of said row for baffling flow away from between the interior side of said tank and the end oil cooler tubes so as to force most of the liquid flowing between said fitting and the one end of said radiator tubes to pass transversely between said oil cooler tubes.

3. In combination, a motor vehicle radiator having a tank, a plurality of radiator tubes connected at one end thereof to said tank, a fitting on said tank for directing liquid into or out of said tank to or from respectively the one end of said radiator tubes, an oil cooler mounted in said tank between the one end of said radiator tubes and said fitting, said oil cooler having a row of tubes extending past and open to the one end of said radiator tubes, said tank having an interior side facing said oil cooler, and perforated baffle means on opposite sides of the one end of said radiator tubes extending between said interior side of sad tank and the oil cooler tubes at each end of said row for baffling flow away from between the interior side of said tank and the end oil cooler tubes so as to force a predetermined major portion of the liquid flowing between said fitting and the one end of said radiator tubes to pass transversely between said oil cooler tubes.

4. In combination, a motor vehicle radiator having a tank, a plurality of radiator tubes connected at one end thereof to said tank, a fitting on said tank for directing liquid into or out of said tank to or from respectively the one end of said radiator tubes, an oil cooler mounted in said tank between the one end of said radiator tubes and said fitting, said oil cooler having a row of tubes extending past and open to the one end of said radiator tubes, said tank having an interior side facing said oil cooler, and baffle means on opposite sides of the one end of said radiator tubes extending between said interior side of said tank and the oil cooler tubes at each end of said row for baffling flow away from between the interior side of said tank and the end oil cooler tubes so as to force liquid flowing between said fitting and the one end of said radiator tubes to pass transversely between said oil cooler tubes while preventing liquid flow around the end oil cooler tubes.

5. The combination as set forth in claim 4 wherein each said baffle means is formed from sheet material with a convex side to coolant flow from the radiator tubes.

6. In combination, a motor vehicle radiator having a tank, a plurality of radiator tubes connected at one end thereof to said tank, a fitting on said tank for directing liquid into or out of said tank to or from respectively the one end of said radiator tubes, an oil cooler mounted in said tank between the one end of said radiator tubes and said fitting, said oil cooler having a row of tubes extending past and open to the one end of said radiator tubes, said tank having an interior side facing said oil cooler, and perforated baffle means on opposite sides of the one end of said radiator tubes extending between said interior side of said tank and the oil cooler tubes at each end of said row for baffling flow away from between the interior side of said tank and the end oil cooler tubes so as to force a major portion of the liquid flowing between said fitting and the one end of said radiator tubes to pass transversely between said oil cooler tubes while allowing a minor portion of the liquid flow to pass around the end oil cooler tubes.

* * * * *